US010535246B2

(12) United States Patent
Dunn

(10) Patent No.: US 10,535,246 B2
(45) **Date of Patent: *Jan. 14, 2020**

(54) SEWER ALARM APPARATUS HAVING A PROBE

(71) Applicant: Firefly Solutions, LLC, Darien, CT (US)

(72) Inventor: Tristram C. Dunn, Darien, CT (US)

(73) Assignee: FIREFLY SOLUTIONS, LLC, Darien, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/027,494

(22) Filed: Jul. 5, 2018

(65) Prior Publication Data

US 2018/0315291 A1 Nov. 1, 2018

Related U.S. Application Data

(63) Continuation of application No. 15/137,599, filed on Apr. 25, 2016, now Pat. No. 10,032,357, which is a continuation-in-part of application No. 14/818,625, filed on Aug. 5, 2015, now Pat. No. 9,508,245, which is a continuation of application No. 14/083,698, filed on Nov. 19, 2013, now Pat. No. 9,127,445.

(51) Int. Cl.

| | |
|---|---|
| ***G08B 21/20*** | (2006.01) |
| ***E03F 7/00*** | (2006.01) |
| ***E03F 5/042*** | (2006.01) |

(52) U.S. Cl.

CPC ..... *G08B 21/20* (2013.01); *E03F 5/042* (2013.01); *E03F 7/00* (2013.01); *E03F 2201/40* (2013.01)

(58) Field of Classification Search

CPC .. G08B 21/20; E03F 5/042; E03F 7/00; E03F 2201/40

USPC ..... 340/604

See application file for complete search history.

(56) References Cited

U.S. PATENT DOCUMENTS

| | | | | |
|---|---|---|---|---|
| 2,761,037 A * | 8/1956 | Thomas | E03F 7/00 | 200/83 S |
| 3,757,316 A * | 9/1973 | Fiorenzo | G08B 21/187 | 340/608 |
| 4,546,346 A * | 10/1985 | Wave | E03F 7/00 | 200/61.2 |
| 4,973,950 A * | 11/1990 | Tourtillott | E03F 7/00 | 340/608 |
| 5,006,833 A * | 4/1991 | Marlowe | E03F 7/00 | 340/605 |
| 7,066,195 B2 * | 6/2006 | Anguera Font | E03C 1/284 | 137/247.29 |

(Continued)

*Primary Examiner* — John A Tweel, Jr.

(74) *Attorney, Agent, or Firm* — Buckley, Maschoff & Talwalkar, LLC

(57) ABSTRACT

According to some embodiments, sewer alarm devices and apparatus are provided for detecting the presence of liquid within a pipe. In some embodiments, the devices and apparatus include a housing including a top portion and a bottom portion, and a probe housing, extending from the bottom portion of the housing to a bottom surface area of the probe housing and sized to fit within an interior of a wye connector, the wye connector having an interior extending into an interior of the pipe. At least a first probe is disposed within the probe housing and exposed to an area between the bottom surface area of the probe housing and the interior of the pipe.

11 Claims, 9 Drawing Sheets

(56) References Cited

U.S. PATENT DOCUMENTS

| | | | | |
|---|---|---|---|---|
| 7,334,536 | B2 * | 2/2008 | Aniban, Jr. | G01F 23/64 116/228 |
| 7,907,059 | B1 * | 3/2011 | Guy | G01F 23/242 137/392 |
| 9,127,445 | B2 * | 9/2015 | Dunn | E03F 7/00 |
| 10,032,357 | B2 * | 7/2018 | Dunn | E03F 7/00 |

* cited by examiner

SEWER ALARM APPARATUS HAVING A PROBE

RELATED APPLICATIONS

This application is a continuation of U.S. patent application Ser. No. 15/137,599 filed on Apr. 25, 2016, which is a continuation-in-part of, and claims benefit of and priority to U.S. patent application Ser. No. 14/818,625 filed on Aug. 5, 2015 (issued as U.S. Pat. No. 9,508,245), which is a continuation of U.S. patent application Ser. No. 14/083,698 filed on Nov. 19, 2013 (issued as U.S. Pat. No. 9,127,445).

FIELD OF THE INVENTION

The present disclosure relates to alarm systems. More particularly, embodiments relate to warning or alarm systems for alerting users of the undesirable presence of liquid (such as sewage) in a line (such as a sewer line or pipe).

BACKGROUND

Homes, offices and other buildings have one or more systems of pipes that are configured to channel wastewater from the building to a sewer system or septic tank. In a common configuration, one or more toilets, sinks, bathtubs, and showers may be connected to a main waste line which is connected to a drain line or lateral that is then connected to a septic system or to a public sewer line. The lateral or drain line may have one or more cleanout valves that allow maintenance access to the lateral or drain line.

Unfortunately, the drain line or lateral may become clogged or backed up. For example, in systems where a drain line or lateral (or portions thereof, such as the portions exterior to a foundation of a building) is formed of terracotta or clay pipe, the line is susceptible to cracking, separation, disturbance or blocking due to tree roots, soil shifting or settling, or the like. A drain line or lateral may also become clogged or blocked when certain items (such as tampons) are flushed down a toilet. When a drain line or lateral (or portion thereof) becomes clogged, cracked or otherwise blocked, the sewage or wastewater that should drain out to the septic system or sewer system backs up into the house or building. Often, the clog may cause a backup and then wastewater may overflow into the building from its nearest open low point. Such overflows or backups can be unpleasant, unhealthy and expensive to repair. Further, many sewer system backups are not covered under a typical homeowner's insurance policy, nor are they covered by flood insurance.

It would be desirable to provide an alarm system that alerts or warns a homeowner (or other individual or entity) of the undesirable or unexpected pending presence of fluid in a pipe such as an upper lateral pipe or other outflow pipe. Several potential solutions have been proposed. For example, in U.S. Pat. No. 4,973,950, a sewer blockage alarm is described which utilizes a pressure sensor switch mounted to the inside of a cap for a sewer clean out branch. Unfortunately, the pressure sensor switch may provide inaccurate readings as a result of air or air bubbles collecting in the sewer clean out branch. Further, the '950 patent requires that a pressure bell extend into an interior of a pipe to be monitored which allows debris, sewage or other material collecting at the end of the pressure bell which, unfortunately can cause clogs or blockage.

U.S. Pat. No. 7,907,059 describes a similar alarm that is mounted in a cap of a pipe. The '059 patent requires the use of probes that extend into a pipe. Unfortunately, each of these systems requires that probes or other components extend to an interior of a pipe to be monitored which can lead to clogs or blockage. Further, these devices require the use of a drain clean out cap associated with a trap (e.g., in the '059 patent, an entire trap system is required to be retrofitted with the alarm). Most modern home or office fixtures (such as sinks, showers, toilets) have their own trap associated with it, making it undesirable to utilize drain clean out caps for use in positioning a monitoring device. Further, the inventor of the present invention has determined that placement of an alarm sensor device in a drain or cleaning pipe does not allow a pipe blockage to be detected sufficiently early enough to be corrected—instead, when a blockage is severe enough that wastewater is backing up to the cleaning pipe, a drain or other exit point (such as a toilet or the like), it is commonly too late for proactive maintenance action.

Canadian Patent No. 890926 (U.S. Pat. No. 1,261,940) describes a water backup alarm system which fits within a vertical pipe that leads to a sewer or septic system. The system is constructed of plastic material that fits entirely within a pipe. Unfortunately, installation of the system requires access to the interior of a pipe (such as, for example, through a cap or the like). Unfortunately, the system effectively reduces the interior dimensions of the pipe (which may result in blockage or obstruction of the pipe or a reduction in the capacity of the pipe). Further, the system requires that a user be able to access a section of pipe with a removable cap. Many homes or other buildings do not have drain systems with ready access to a suitable cap or section of pipe with a cap.

Accordingly, it would be desirable to provide a sewer alarm system which does not use a component which extends into the interior of a pipe being monitored. Further, it would be desirable to provide a sewer alarm system that is easily mounted or fitted on an existing drain line or lateral. Further still, it would be desirable to provide a sewer alarm system which does not substantially block or impair the flow of wastewater through the drain line or lateral.

DETAILED DESCRIPTION

Embodiments relate to alarm systems that are usable to detect the undesired presence of fluid in a pipe system. In some embodiments, alarm systems are provided to detect the undesired presence of wastewater in a sewage system.

A number of terms are used herein for convenience and ease of exposition. For example, the term "sewage system" will be used to refer to waste drainage systems, including septic and sewer systems. The term "drain line" is used to refer to a pipe, system of pipes, or other connectors that deliver wastewater from out of a building to a sewage system. A drain line may be a plastic (PVC or the like), metal, clay or other material. Embodiments may be used in both commercial and residential applications.

Figure 1:
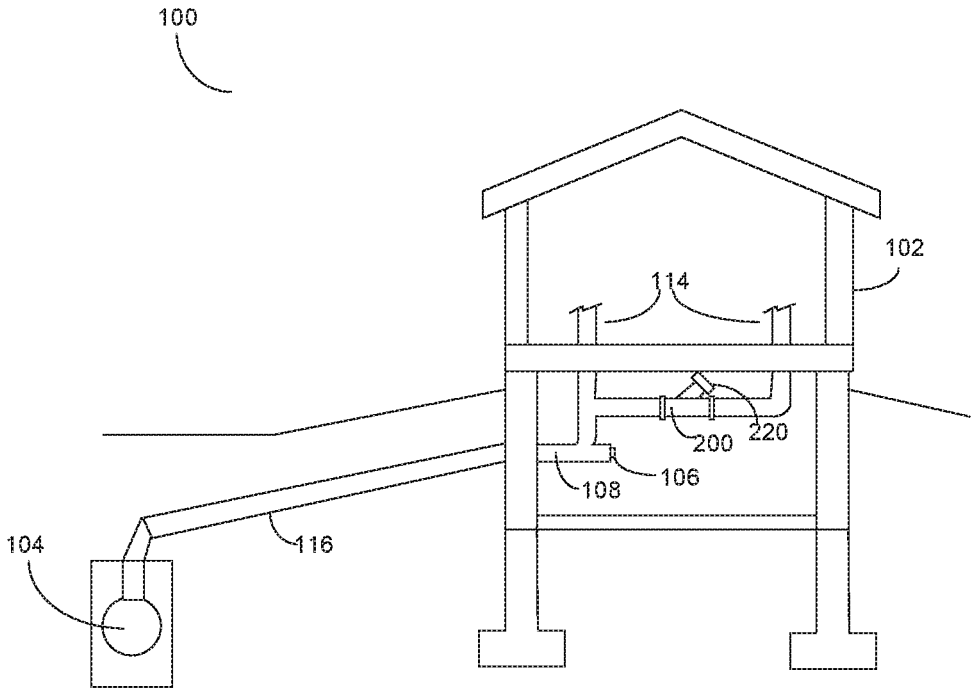
FIG. 1 is a sectional view of a building and sewer line having a sewer alarm according to some embodiments.

Features of some embodiments will now be described by reference to the drawings. Reference is first made to FIG. 1, where a sectional view of a building 102 is shown in which a sewer alarm system 220 pursuant to some embodiments has been installed. In the embodiment shown in FIG. 1, a building 102 is connected to a sewer line 104 via a section of underground pipe referred to herein as a lateral 116 and a second section referred to herein as drain line 108. Often, the drain line 108 exits the building through a point in the foundation of the building 102. Pursuant to some embodiments, the sewer alarm system 220 of the present invention may be located near the point where the drain line 108 exits the building 102 (as that point is the lowest point of the drain line 108 and provides a desirable location for identifying the presence of undesired wastewater). The drain line 108 may be connected to one or more other drain pipe systems 114 from within the building 102 (for example, the drain systems 114 may be connected to toilets, dishwashers, sinks, or other devices in the building 102). While only two drains 114 are shown, in a typical building multiple drain lines may feed into the drain line 108. One drain line 108 is shown in FIG. 1, although those skilled in the art will appreciate that a building 102 may have more than one drain line to deliver wastewater to the lateral 116 for eventual delivery to a sewer or septic system. Although not shown in FIG. 1, the drain lines 114 may be connected to devices such as dishwashers, toilets, showers, bathtubs, or the like within the building 102.

The drain line 108 exits the building (e.g., through a via or cut or recess in the foundation) and may have a cap or cleanout 106 which may, in some situations, be removed to allow cleaning materials from the drain line 108 or other access to the drain line 108 or the lateral 116. Pursuant to some embodiments, a sewer alarm system 220 may be mounted on retrofitted pipe section 200 which may be installed by cutting a short section of the main drain line 108 (where the cut section is selected to be sized for the length of the retrofitted pipe section 200). A flexible rubber fitting or sleeve (not shown) may be used to connect the retrofitted pipe section 200 to the main drain line 108. For example, the flexible rubber fittings provided by Fernco, Inc. may be used to provide a leak-proof seal between the retrofitted pipe section 200 and the drain line 108. In some embodiments, the sewer alarm system of the present invention may be installed with a new build or a new drain line installation, by using standard plumbing techniques to provide a leak-proof seal between a pipe section 200 and a drain line 108. In either event, the retrofitted pipe section 200 is positioned on a main sewer line or a lateral line. The sewer alarm may be positioned on a vertical or a horizontal line such that the wye extension is above the normal flow of sewage or fluid.

Figure 2:
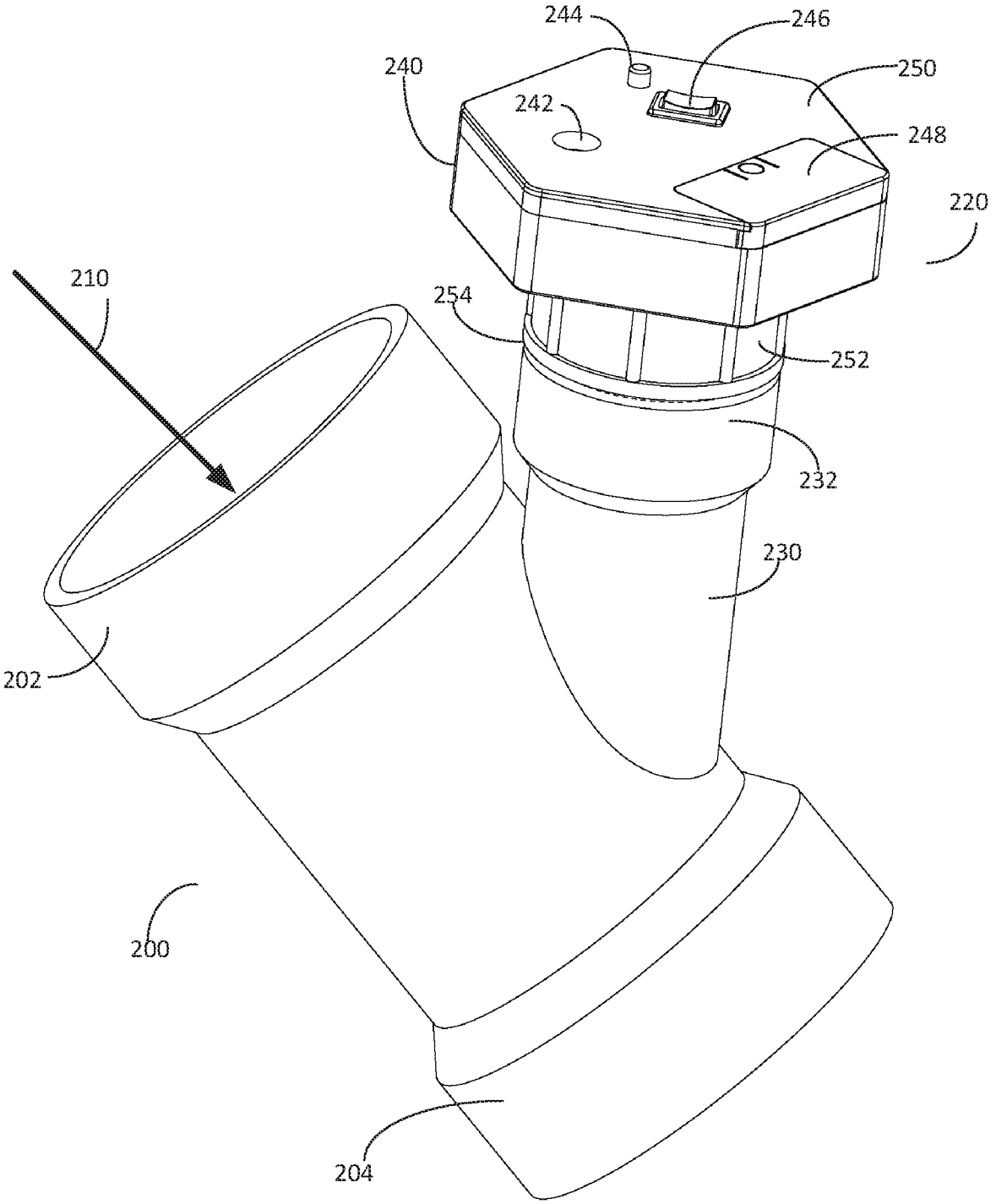
FIG. 2 is a view of a sewer alarm system according to some embodiments.

In some embodiments, the sewer alarm system 220 is positioned on a portion of a drain line 108 or other pipe in the building that is in communication with a lateral 116 or other pipe system that delivers wastewater to a sewer or septic system. In some embodiments, the sewer alarm system 220 is positioned on a pipe or drain line that is substantially horizontal such that the alarm system 220 may detect the presence of undesired wastewater or fluid caused by a blocked or damaged pipe downstream from the area where the sewer alarm system 220 is mounted. FIG. 2 shows more details of the pipe section 200. In some embodiments, the pipe section 200 is a hub connector, and the sewer alarm system 220 is mounted on a wye terminator of the hub connector 200. For example, in an installation where the drain line 108 is a 4 inch PVC line, the hub connector 200 may be a 4 inch hub×hub×hub connector that can be installed in the drain line 108 by cutting the drain line 108 and bridging the cut with the hub connector 200. The wye connector 230 terminates at an end 232 that receives the sewer alarm system 220. For example, the wye connector 230 may be a 2 inch wye that terminates at a flange 232 that may receive a threaded fixture 252 into which the sewer alarm system 220 may be threaded. The connection between the threaded fixture 252 and the sewer alarm system 220 may include one or more seals 254. As shown, the hub connector 200 is preferably installed on the drain line 108 in an orientation in which the normal fluid flow follows the direction of the arrow 210.

In some embodiments, the sewer alarm system 220 may be positioned on a pipe or drain line that is vertical or that otherwise provides a position allowing the sewer alarm system 220 to detect the presence of undesired wastewater or fluid caused by a blocked or damaged pipe downstream from the area where the system 220 is positioned. In some buildings, multiple sewer alarm systems 220 may be used to ensure early detection of blocked or clogged lines. Preferably, the sewer alarm system 220 is mounted on a pipe or drain line that is at or near a low exit point from the building 102. As shown in FIG. 1, the sewer alarm system 220 is shown as being positioned horizontally, however the system 220 may be positioned vertically or in a semi-vertical or semi-horizontal position. In general, the system 220 is desirably mounted near the low point of the drain line near the point where the drain line 108 exits the foundation of the building 102.

For example, in the system depicted in FIG. 1, the alarm system 220 is positioned in the basement of the building 102 near the egress of the drain pipe 108 through the foundation to the lateral pipe or line 116. This position may provide desirable results with the alarm system 220 of the present invention as it allows relatively early detection of a potential blockage of the lateral 116 or drain pipe 108. Further aspects of the positioning and installation of the alarm system 220 of the present invention will be described further herein by reference to the drawings that follow.

Sewer and other drain systems (such as shown in FIG. 1) commonly suffer from clogged, blocked or broken pipes or drain lines which can cause wastewater to back up into a building. When such a system backs up, the wastewater can enter the building through one or more open drain pipes or fixtures, causing significant damage to the building as well as inconvenience to the occupants and the potential to spread undesirable mold and disease. Many older sewer and septic lines are constructed of clay or other pipes that are susceptible to root invasion from plants and trees. For example, tree roots thrive on the moisture and bacteria from a sewer line, and are often able to penetrate a pipe. As the root grows, it can snag waste and cause a backup or clog that can only be corrected by attempting to use a snake or other tool to clean or clear an interior of the pipe or by digging the pipe up. Further, many buildings have septic systems. These systems fail after a period of use (up to 2-3% of homes with septic tanks experience a failure each year). The sewer alarm system 220 of the present invention may be used to provide a warning of a potential failure as the backup of wastewater often precedes or is associated with a septic tank failure.

It is desirable to detect such backups or clogs early, before damage to the property occurs. Embodiments of the present invention provide a convenient and accurate way to provide early detection of the presence of such backups. As will be described further herein by reference to the drawings, embodiments provide a sewer alarm system 220 that can be easily mounted on an existing pipe (such as a drain pipe 108 or the like) in a way which provides ease of access to the sewer alarm system 220 as well as which provides accurate and repeatable results.

Reference is again made to FIG. 2. In some embodiments, the sewer alarm 220 is formed with a shaped housing 240 that is formed of a polyvinyl material or other shaped or molded material. The shaped housing 240 and the overall dimensions of the sewer alarm system 220 may be sized to match the type and/or size of pipe on which they are mounted. For example, in embodiments where the sewer alarm system 220 is to be installed in a wye connector 230 that is 2 inches in diameter, the shaped housing 240 may be formed to be slightly larger than the wye connector 230. A probe housing (not shown in FIG. 2) extends from a base of the shaped housing 240 into the wye connector 230. In general, the shaped housing 240 may be formed of substantially any size or shape so long as the size and shape are suited to the electronics. In the embodiment shown in FIG. 2 and elsewhere herein, the shaped housing 240 has a number of sides which make it easier for an installer to screw the housing 240 (and the probe housing) onto the connector 232 of the wye housing 230. For example, a homeowner or other individual may easily install the housing sewer alarm 220 by simply rotating the housing 240 to screw the alarm 220 into the wye connector 230. This allows a user to easily add or remove the sewer alarm 220.

In some embodiments, one or more gaskets 254 may be positioned between the lower portion 252 of the shaped housing 240 and the upper portion 232 of the wye connector 230. For example, in some embodiments, the gasket may be formed of foam or rubber, providing a water tight seal between the sewer alarm 220 and the wye connector 230. The use of a gasket may also provide other desirable benefits. For example, the use of a gasket can allow a homeowner or other installer to tighten the shaped housing 240 onto the wye connector 230 in a manner which doesn't harm the wye connector 230 or the sewer alarm 220 and which assures the installer that the sewer alarm 220 is tightly mounted onto the wye connector 230.

In some embodiments, the shaped housing 240 of the sewer alarm 220 includes one or more covers such as an electronics cover 250 and a battery cover 248. Each or all of the covers may be removably attached to the shaped housing 240 (e.g., using recessed screw mounts or the like), allowing access to the battery (in the case of the battery cover 248) and the electronics and speaker 242 (in the case of the electronics cover 250). While two separate covers are shown in the embodiment illustrated in FIG. 2, any number of covers may be used to provide convenient access to some or all of the components of the sewer alarm system 220.

In some embodiments, the sewer alarm system 220 includes one or more switches 244, 246 as well as a speaker 242. As will be described further below, the switches 244, 246 allow the sewer alarm system 220 to be activated or deactivated (e.g., using switch 246) and tested (e.g., using switch 244). The speaker 242 is selected to provide an audible alert when the presence of backed up wastewater is detected by the sewer alarm system 220. While a speaker may be used, in some embodiments, as will be described further below, other alerting devices may also be used (such as, for example, lights, WiFi or cellular signals, or the like). For example, in some embodiments, the sewer alarm system 220 may placed in communication with an existing home alarm system such that a notice or other alert may be issued through the home alarm system when the presence of backed up wastewater is detected. In some embodiments, an external power source (as described below in conjunction with FIG. 9) may be coupled to the alarm using a jack (not shown in FIG. 2 but shown in FIG. 3 as item 264). An external alarm (as described below in conjunction with FIG. 9) may be coupled to the alarm system 110 using an alarm connector (not shown in FIG. 2 but shown in FIG. 3 as item 262).

Figure 3:
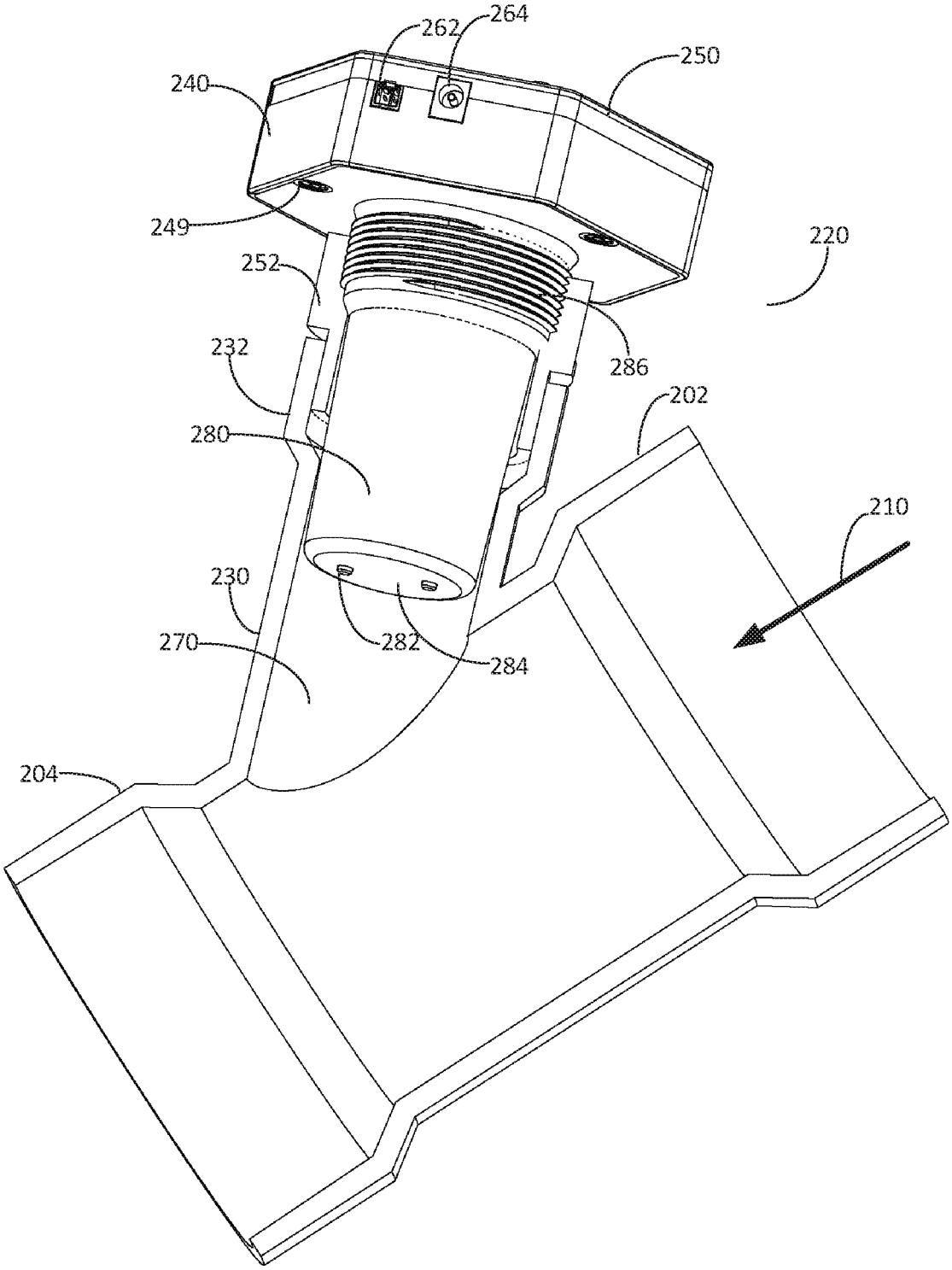
FIG. 3 is a view of a sewer alarm system according to some embodiments.

Reference is now made to FIG. 3, where a further view of the sewer alarm system 220 and the section of pipe 200 are shown according to some embodiments. The section of pipe 200 is shown in partial cross section to illustrate how the sewer alarm system 220 is installed in the wye connector 230. In the view shown in FIG. 3, the interior of the section of pipe 200 is shown in more detail, including details of the area 270 where the wye connector 230 is in communication with the interior of the section of pipe 200. The normal direction of fluid flow is shown as item 210. As fluid flows normally, little or no fluid will collect or be in area 270. However, if fluid is not flowing normally (e.g., due to a backup or clog), fluid may gather or fill the area 270. As this happens, one or more probes 282 (or pairs of probes 282) on a bottom face 284 of a probe housing 280 of the sewer alarm 220 will be activated and cause the alarm to sound. In the embodiment shown in FIG. 3, two probes 282 are shown on the bottom face 284 of the probe housing 280; however, in other embodiments, additional probes may be provided. For example, in the embodiment of FIG. 8, four probes 282 are shown. The use of additional probes provides increased accuracy in detecting the undesired presence of wastewater at the probes 282. In some embodiments, pairs of probes are used such that the presence of fluid across both probes in a pair causes an electrical circuit to be completed.

As shown, the shaped housing 240 of the sewer alarm system 220 has a probe housing 280 that extends into the wye connector 230. A bottom face 284 of the probe housing 280 has one or more probes 282 (or pairs of probes 282) that are positioned toward an interior of the section of pipe 200. As shown in the embodiment of FIG. 3, the bottom face 284 may be parallel to the shaped housing (or perpendicular to the center axis of the probe housing 280); however, in some embodiments (such as shown and discussed in conjunction with FIG. 8) the bottom face 284 may be formed such that the face 284 is parallel to the center axis of the section of pipe 200.

Figure 8:
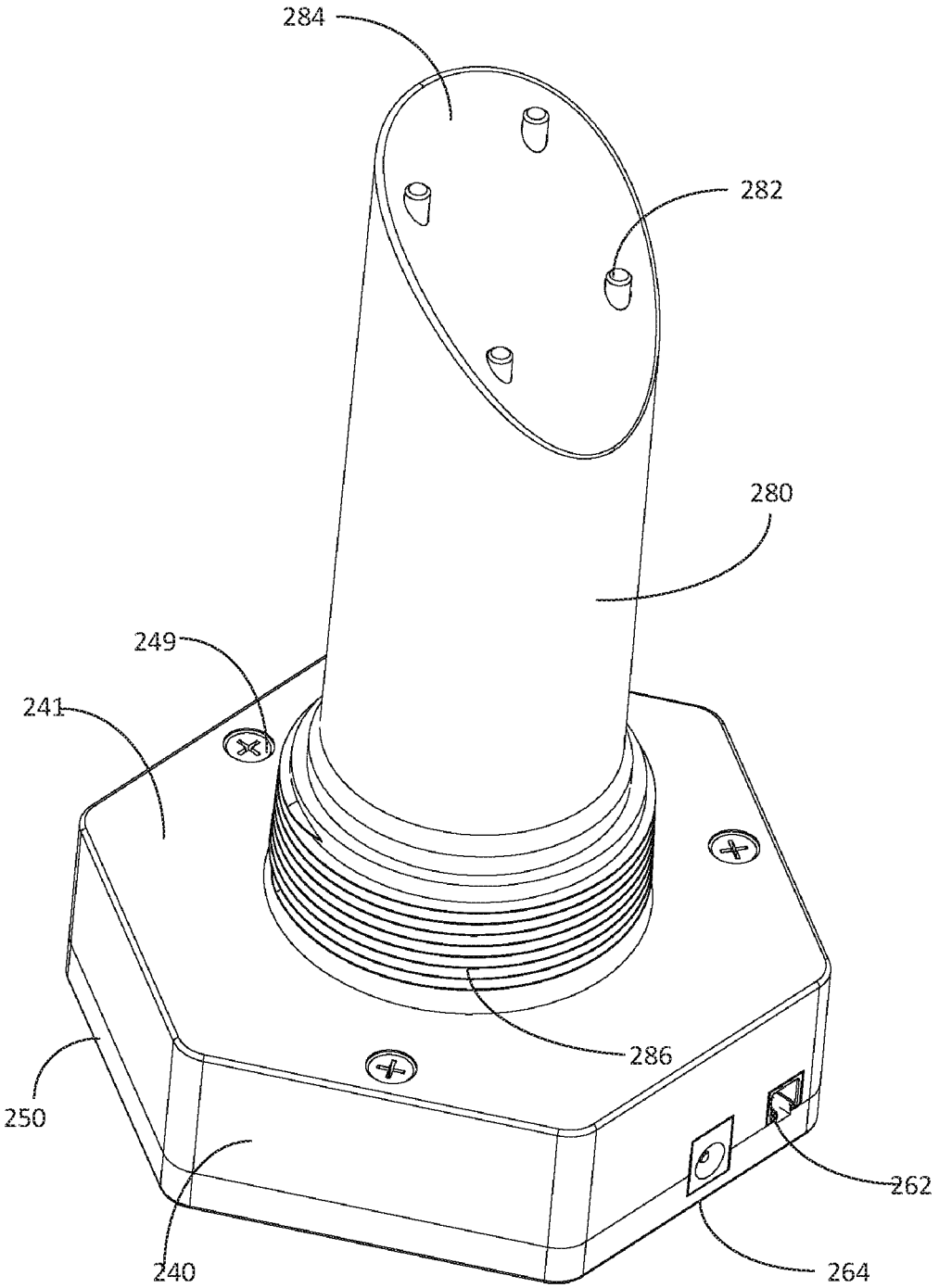
FIG. 8 is a view of a portion of the sewer alarm system according to some embodiments.

For example, referring to FIG. 8, in such embodiments, the bottom face 284 of the probe housing 280 may have a sloped or angled surface that is positioned such that the normal direction of flow of wastewater through the section of pipe 200 flows across the sloped or angled bottom face 284 of the probe housing 280. For example, the normal flow of wastewater through pipe 200 is indicated by the direction of arrow 210. The probe housing 280 houses one or more probe elements 282 which are protected from detecting the presence of wastewater during normal flows (i.e., when wastewater is flowing lower in the pipe, such as in the direction of arrow 210). However, when the pipe (or downstream pipes such as a lateral) becomes blocked, and wastewater collects or accumulates in area 270 near the bottom face 284 of the probe housing 280, the probe elements 282 are operated to trigger operation of the sewer alarm system 220 (e.g., to cause an alarm to sound, thereby alerting a home occupant or other entity of the possible blockage of the pipe system, as described below, the alarm that sounds may be an external alarm such as a home alarm system or it may be the alarm device mounted within the alarm system 220). Whether the bottom face 284 of the probe housing 280 is perpendicular (as shown in FIG. 3) or angled (as show in FIG. 8), the bottom face 284 is preferably positioned so that it does not extend within the interior of the section of pipe 200 (e.g., such that it does not interfere with the normal flow of fluid through the pipe, and such that it does not provide a surface on which debris or waste can collect).

Referring again to FIG. 3, the sewer alarm system 220, in some embodiments, is easily installed into the wye connector 230 by threading the system into a receiving thread system 252 of the wye connector 230. The receiving thread system 252 may be glued or otherwise securely affixed to (or formed as part of) the wye connector 230. A set of threads 286 are formed on a top portion of the probe housing 280 that extends away from the shaped housing 240 of the sewer alarm 220.

Figure 4:
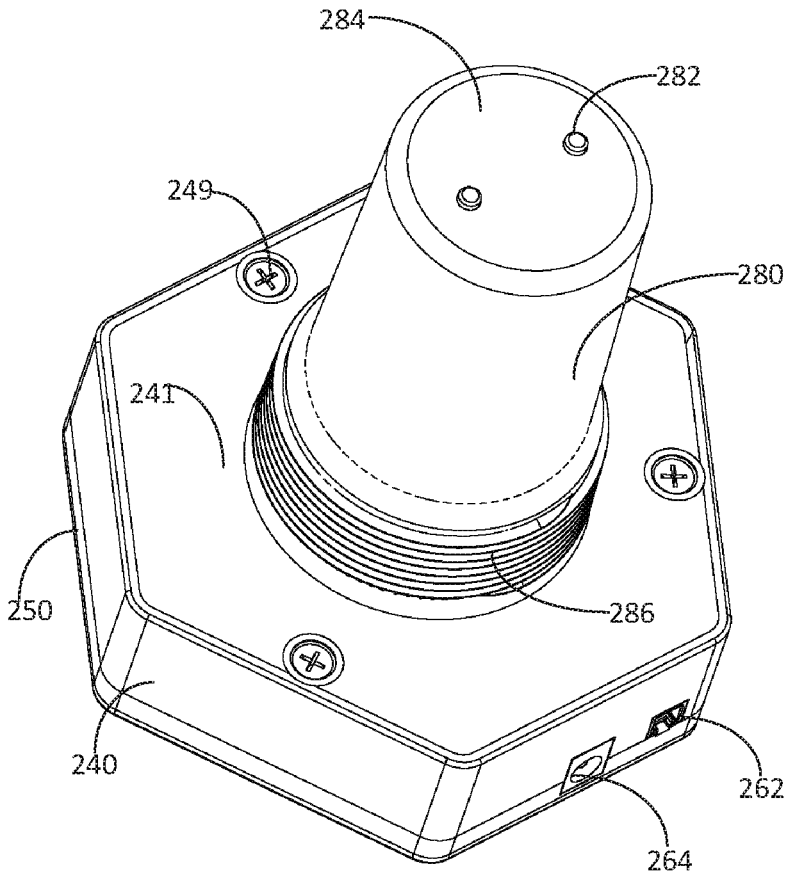
FIG. 4 is a view of a portion of a sewer alarm system according to some embodiments.

Further details of some embodiments of the probe housing 280 and shaped housing 240 of the sewer alarm system 220 are shown in FIG. 4. FIG. 4 is a view of a bottom surface 241 of the shaped housing 240, where the bottom surface 241 is the surface that faces toward the wye connector (not shown in FIG. 4) and that extends to the probe housing 280. In some embodiments, the bottom surface 241 may include one or cutouts, recesses, or the like, allowing one or more screws or other attaching devices 249 to secure the bottom surface 241 (and the probe housing 280) to the shaped housing 240 of the sewer alarm system 220. Detaching the bottom surface 241 from the shaped housing 240 may allow access to the electronics and control circuitry therein.

The probe housing 280 extends from the body of the shaped housing 240 from the bottom surface 241. For example, the probe housing 280 may be sized such that the probe elements 282 are positioned proximate to the inner surface of the pipe section 200. In some embodiments, the probe housing 280 has a length selected to place the probe elements 282 within ¼ to ½ inches from the inner surface of the pipe section 200. In some embodiments, the probe housing 280 has an exterior diameter selected to allow the probe housing 280 to securely fit within the wye connector 230. For example, if the wye connector 230 has a 2 inch diameter, the exterior diameter of the probe housing 280 may be selected to be slightly less than 2 inches in diameter. In some embodiments, one or more gaskets or flanges may be disposed along the exterior surface of the probe housing 280 to ensure a tight fit within the wye connector 230. This allows the probe elements 282 to be positioned such that they may be exposed to wastewater at the top of the wastepipe in the event of a backup, while preventing wastewater from collecting near the top of the probe housing 280 (e.g., near the bottom surface 241 of the shaped housing 240).

Figure 5:
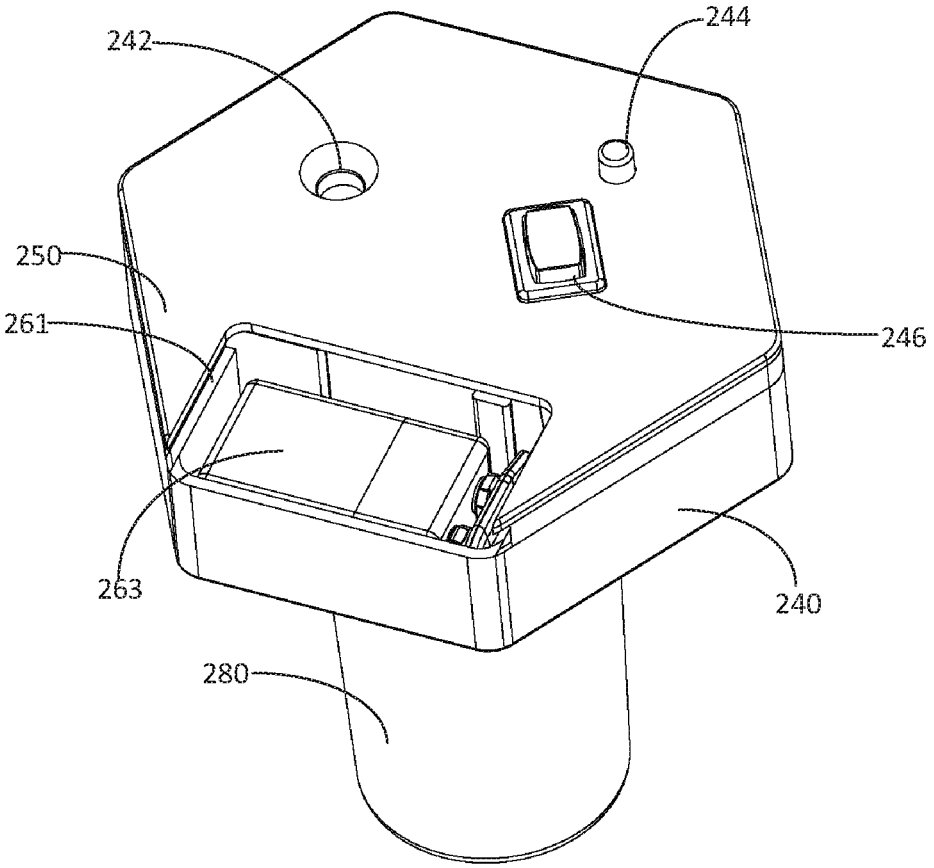
FIG. 5 is a view of a portion of a sewer alarm system according to some embodiments.

Further details of the shaped housing 240 and probe housing 280 pursuant to some embodiments are shown in FIG. 5. In FIG. 5, the top 250 of the shaped housing 240 is shown with a battery cover removed (exposing a view of the battery 263 in a battery holder 261). The battery cover 248 is shown installed, for example, on FIG. 2. The top 250 of the shaped housing 240 provides convenient access to controls and components, including a speaker 242, a power switch 246, and a test switch 244 described elsewhere herein. The shaped housing 240 is formed with the probe housing 280 extending therefrom, allowing the probe housing 280 and the alarm system to be easily installed by screwing the entire structure into a wye connector (as described in conjunction with FIG. 3 above).

Figure 6:
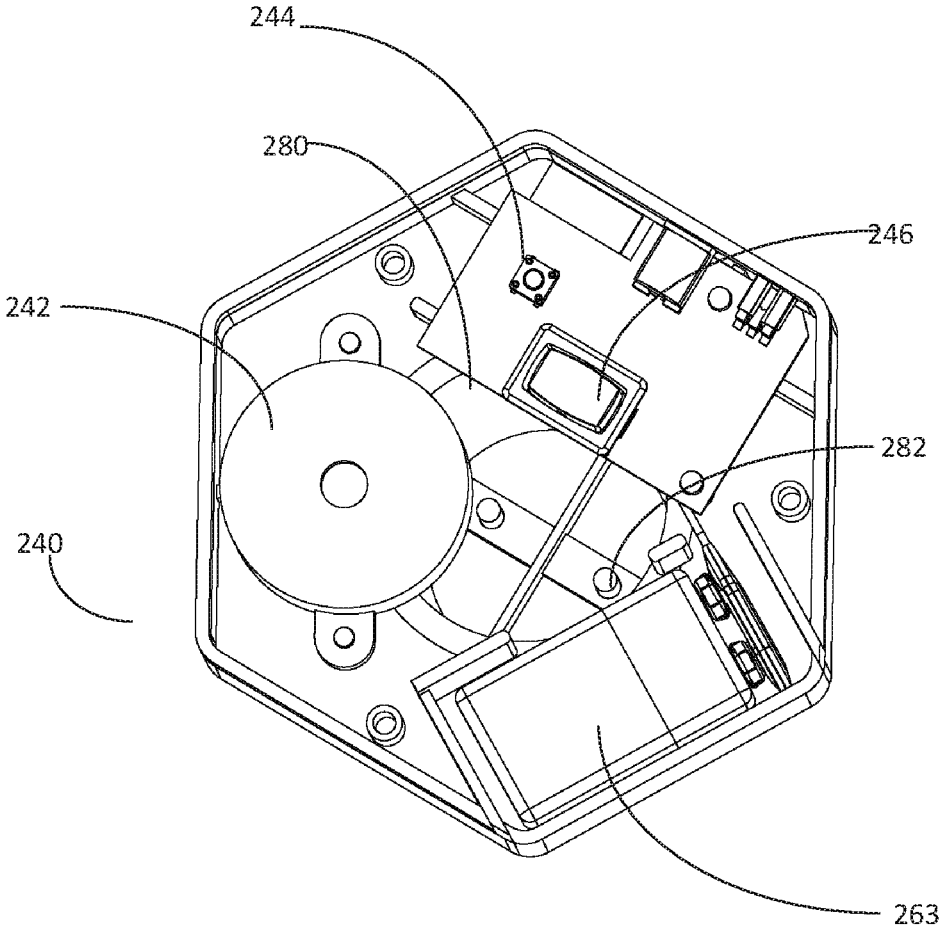
FIG. 6 is a view of a portion of a housing of a sewer alarm system according to some embodiments.

Referring now to FIG. 6, a view of a portion of the interior of shaped housing 240 pursuant to some embodiments is provided. The shaped housing 240 be used to house electronics such as one or more speakers 242, a power source such as a battery 263, a test switch 244 and an on/off switch 246. The shaped housing 240 may also house one or more circuit boards and other electronics such as described further below in conjunction with FIG. 9. The housing 240 may be formed to include or be coupled with the probe housing 280 providing a dry and sealed connection to the probe elements 282. The circuit board may be formed to provide electrical connections between the battery 263 and other components, including the switches 244, 246 and speaker 242. In some embodiments, other power sources may be provided and the battery 263 may be used as a backup power source. In some embodiments, other types of alerting devices may be used (in addition to, or instead of the speaker 242) such as, for example, a connection to an existing or other alarm system. In some embodiments, a test button or mechanism may also be used to allow a user to test or verify the operation of the alarm system 220.

Figure 7:
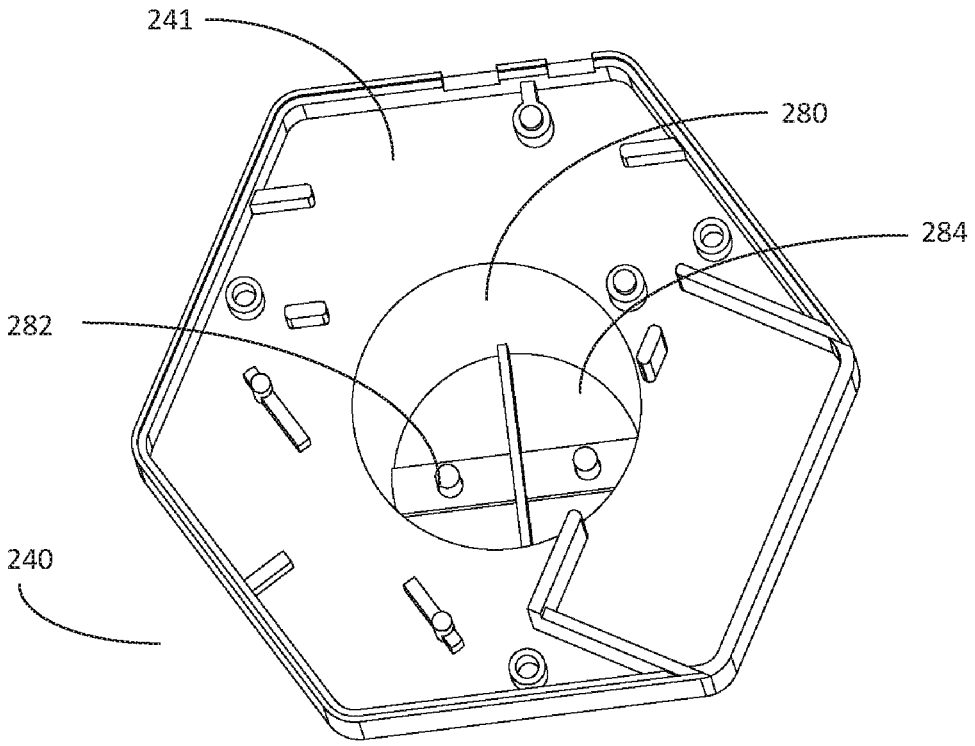
FIG. 7 is a view of a portion of the sewer alarm system according to some embodiments.

Referring now to FIG. 7, a further view of the shaped housing 240 is shown (prior to installation of the circuit board and other electronics). In particular, the shaped housing 240 and portions of the probe housing 280 are shown. The probe housing 280 is formed in a base of the shaped housing 240 and includes a bottom face 284 that is positioned near a top of the pipe in which the sewer alarm is installed (e.g., as shown in FIG. 3). One or more probe elements 282 (or pairs of probe elements 282) are positioned on the bottom face 284 and extend from the inside of the probe housing 280 to the outside of the bottom face 284 of the probe housing 280. Electrical contacts for the probes 282 extend upward through the probe housing 280 for connection with the circuit board and other electronics housed in the shaped housing 240. In some embodiments, the probe housing 280 and the shaped housing 240 are formed to provide a watertight or waterproof enclosure protecting the electronics of the sewer alarm 220.

Figure 9:
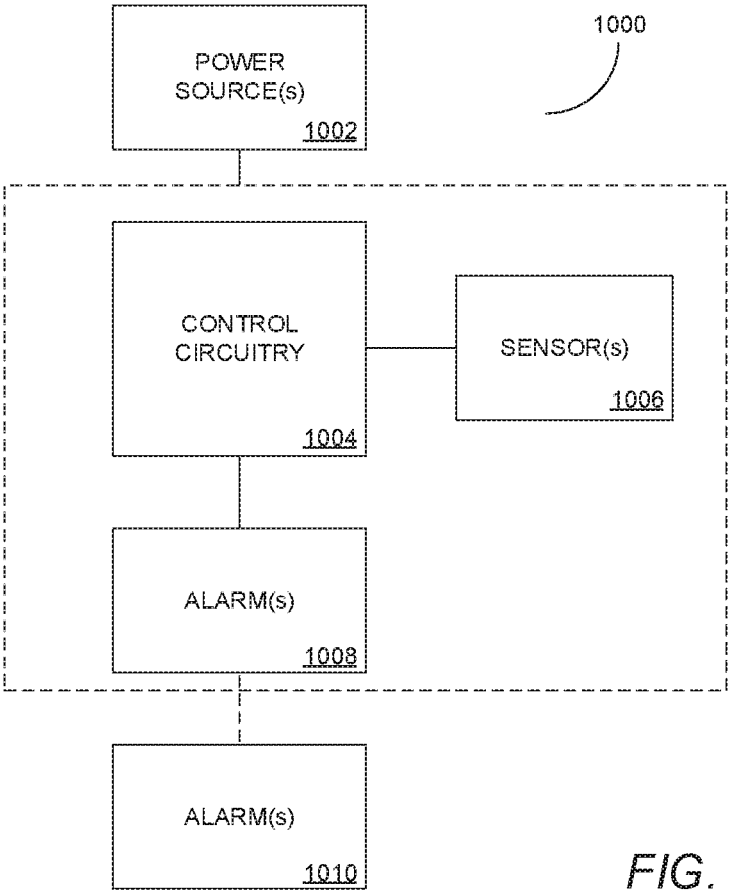
FIG. 9 is a block diagram of the electronics of a sewer alarm according to some embodiments.

Reference is now made to FIG. 9, where a block diagram 1000 is shown depicting certain components of some embodiments of the present invention. As shown, in some embodiments, the sewer alarm of the present invention includes a number of electrical components that together operate to provide an alert or alarm to a user (such as a homeowner, building owner, maintenance worker or the like) in the event of a clog or backup in a drain system. As depicted in FIG. 9, the components may include control circuitry 1004, one or more power sources 1002, one or more sensors 1006 and one or more alarms 1008. Pursuant to some embodiments, the power sources 1002 may include one or more of a battery (e.g., such as a 9 Volt battery mounted in the shaped housing 128 of the alarm system) as well as an external power source. For example, the external power source may be provided by a wall adapter plug (such as, for example, a 9 Volt DC adapter). Other battery or adapter types may also be used (for example, 12 Volt batteries or adapters, or the like). In some embodiments, a battery may be used as a backup power source and the external power source may be used as the primary power source. The power sources 1002 supply power to the control circuitry 1004, the sensor(s) 1006 and the alarm(s) 1008. In some embodiments, some portion of the power source(s) 1002, control circuitry 1004, sensor(s) 1006 and alarm(s) 1008 may be mounted on a circuit board contained within the shaped housing 240 of the alarm system 220.

In one example embodiment, switching between the power sources 1002 (e.g., such as switching from the external power source and the backup power source) may be controlled using a control circuit such as the Low Loss PowerPath Controller (manufacturer's part number LTC4412ES6#PBF) offered by Linear Technologies. Other suitable circuits may also be used with desirable results.

In some embodiments, the control circuitry 1004 may include circuitry that receives data from one or more sensor(s) 1006 and that controls the operation of one or more alarm(s) 1008, 1010 to alert homeowners, building owners, maintenance personnel or the like of the presence of potentially undesirable wastewater. A number of different circuits may be used to implement the functions of control circuitry 1004. In one illustrative but not limiting example, the control circuitry 1004 may include a comparator such as, for example, an ultralow power quad comparator offered by Linear Technologies (e.g., such as manufacturer part number LTC1444IS#PBF). Other controllers, including, for example, microprocessor controllers, may also be used with desirable results.

In some embodiments, the one or more alarm (s) 1008 may include a speaker or other device which emits an audible tone when the presence of wastewater is detected by the sensor(s) 1006. For example, one suitable speaker is part number PS-562Q offered by Mallory Sonalert Products, Inc., although a wide variety of other speakers or devices may be used with similarly desirable results. In some embodiments, in addition to an audible alarm, one or more visual alarms may also be utilized (e.g., such as an LED or other light source which is enabled when the sensor(s) 1006 detect the undesirable presence of wastewater). In some embodiments, the alarm(s) 1008 may include other forms of notification. For example, in some embodiments, the alarm(s) 1008 may include one or more remote alarm(s) 1010 which are activated via remote connection such as via a WiFi, Bluetooth or other network connection which causes an alert to be transmitted to a remote recipient. For example, in some embodiments, when the undesirable presence of wastewater is detected by the sensor(s) 1006, an email, text message, or other notification may be transmitted from the alarm(s) 1008 to a remote recipient alerting the recipient of the presence of wastewater. In some embodiments, a cellular or other wireless connection may be provided to facilitate such communication.

Embodiments of a sewer alarm have been described herein in the context of identifying backups or potential backups in residential, commercial, industrial and other building applications, but it should be understood that other applications are possible. For example, embodiments may be used to detect the undesirable presence of fluids in other types of drainage systems.

The above description and/or the accompanying drawings are not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A sewer alarm, comprising:

a housing including a top portion and a bottom portion;

a probe housing, extending from the bottom portion of said housing to a bottom surface area of the probe housing and sized to fit within an interior of a connector that extends to an interior of the pipe, wherein the bottom surface area of the probe housing is angled to substantially match an angle at which the connector meets the interior of the pipe;

at least a first probe disposed within said probe housing and exposed to an area between the bottom surface area of the probe housing and said interior of the pipe; and wherein said bottom portion of the probe housing is positioned to allow liquid to contact said at least first probe during a non-normal flow of liquid within said pipe, said contact causing operation of an alarm.

2. The sewer alarm of claim 1, wherein the bottom portion of the housing further includes:

a threaded portion for securing the bottom portion within a cap of the connector.

3. The sewer alarm of claim 1, wherein the bottom portion of the probe housing is shaped to fit within the interior of said connector.

4. The sewer alarm of claim 1, wherein the bottom surface area of the probe housing is shaped to match an angle of the connector.

5. The sewer alarm of claim 1, further comprising:

at least a second probe disposed within said probe housing, said at least first and second probes configured to detect the presence of liquid during a non-normal flow of liquid within said pipe.

6. The sewer alarm of claim 1, wherein at least a portion of said top portion of said housing is removably attached to said bottom portion.

7. The sewer alarm of claim 1, further comprising:

a control circuit disposed within said interior volume of said housing, said control circuit in electrical communication with said at least first probe; and an alarm, said alarm engaged when said control circuit receives a signal from said at least first probe indicating the presence of liquid during a non-normal flow of liquid within said pipe.

8. The sewer alarm of claim 7, further comprising:

at least a first power source coupled to said control circuit and said alarm.

9. The sewer alarm of claim 7, further comprising:

an external alarm device in wireless communication with said control circuit.

10. The sewer alarm of claim 1, wherein said probe housing is substantially cylindrical in shape and has a length selected such that the area between the bottom surface area of the probe housing and said interior of the pipe is less than one inch.

11. The sewer alarm of claim 1, wherein said pipe is a drain pipe in a building sewer system and the sewer alarm is positioned near a point where the drain pipe exits the building.

* * * * *